United States Patent [19]

Melli

[11] 3,990,624

[45] Nov. 9, 1976

[54] DISPOSABLE, OPEN, PUNCHED CARDBOARD CONTAINER, PARTICULARLY FOR BOTTLES AND VARIOUS OBJECTS

[75] Inventor: Gino Melli, Reggio Emilia, Italy

[73] Assignee: Nelsen Industrie Chimiche S.p.A., Reggio Emilia, Italy

[22] Filed: Mar. 31, 1975

[21] Appl. No.: 563,658

[30] Foreign Application Priority Data

Apr. 10, 1974 Italy ..... 46810/74

[52] U.S. Cl. ..... 229/27; 206/45.33; 206/433; 206/521; 229/14 C; 229/15

[51] Int. Cl.[2] ..... B65D 5/48

[58] Field of Search ..... 229/14 C, 29 C, 29 R, 229/28 R, 15, 42, 27; 206/45.33, 491, 497, 429, 432, 433, 434, 521, 523

[56] References Cited

UNITED STATES PATENTS

| | | | |
|---|---|---|---|
| 1,888,096 | 11/1932 | Shaw | 206/44 R |
| 3,476,235 | 11/1969 | Mills et al. | 229/14 C |
| 3,656,614 | 4/1972 | Jacobson | 206/432 |
| 3,807,622 | 4/1974 | Belcher et al. | 229/14 C |

FOREIGN PATENTS OR APPLICATIONS

| | | | |
|---|---|---|---|
| 1,522,977 | 10/1969 | Germany | 229/15 |

*Primary Examiner*—William Price
*Assistant Examiner*—Bruce H. Bernstein
*Attorney, Agent, or Firm*—Brisebois & Kruger

[57] ABSTRACT

Cardboard support or disposable container consists of a single quadrangular cardboard sheet on which many longitudinal zones are formed by means of predetermined creasing lines; at these lines parallel ribs are formed by folding the cardboard sheet; the sheet is transversely subdivided into three zones, notches of substantially "T" configuration being provided to enable the two end zones to be folded back vertically with respect to the central zone.

8 Claims, 8 Drawing Figures

DISPOSABLE, OPEN, PUNCHED CARDBOARD CONTAINER, PARTICULARLY FOR BOTTLES AND VARIOUS OBJECTS

SUMMARY OF THE INVENTION

At the present time, glass and plastics bottles are packaged in dozens or other convenient quantities by placing them on a corrugated cardboard tray or container open at the top, the tray with its bottles then being enclosed in a wrapping of synthetic thermoretractable material to form the package.

All known types of cardboard packages present disadvantages deriving from their low mechanical resistance to buckling, which prevents their stacking and prejudices the integrity of the bottles contained in them.

In particular the insufficient rigidity of known cardboard packages gives rise to a double set of disadvantages. When said cardboard packages are used for packaging thin walled plastics or glass bottles, the bottles are squashed vertically on stacking so making it impossible to pile the cardboard containers one on the other. If the packages or containers do not rest on a prefectly flat surface, the bending of the base causes lateral pressure on the plastics or glass bottles which can deform the former or cause breakage of the latter.

Cardboard containers able to meet the requirements of possible stacking and preserve the integrity of the contents under the least favourable working conditions involve a series of constructional complications which make their use uneconomical.

The same problems arise in packaging any fragile material, such as food pasta, ceramic tiles or the like, for which at present cardboard containers are used which are very bulky, complicated and costly.

The object of the present invention is to provide an open support or container of punched cardboard for packaging glass or plastics bottles or other fragile materials, which obviates all the aforementioned disadvantages and at the same time is of simple and economical construction and very easy to assemble.

A further object of the invention is to provide a cardboard support or containers for packaging glass, plastics or fragile synthetic bottles, packets of various food or other products, and objects having any form which enables them to be piled or stacked, which may be formed by punching a single sheet of cardboard and giving rise to the minimum possible wastage, to the advantage of its economy of construction.

A further object of the invention is to provide a container which may be assembled without stitching by simply folding said sheet.

According to the invention the open cardboard support or container is obtained from a single sheet of suitably robust corrugated cardboard divided into the same number of longitudinal strips as there are rows of glass bottles, containers, plastics bottles or various objects to be packaged.

Said longitudinal strips are generally located parallel to the major side of the sheet, which is quadrangular.

Each of these zones is separated from the adjacent zones or lateral edges of the sheet of cardboard by a like number of zones defined by predetermined creasing lines adapted to allow cusp or concertina folding in such a manner as to create a number of ribs parallel and adjacent to the zones in which the goods are placed, to separate these latter zones one from another.

Parallel to the two minor sides of the quadrangular cardboard sheet there are two predetermined creasing lines adapted to allow right angle folding upwards of the two end flaps of the sheet with respect to the central flap.

At said predetermined creasing lines notches of substantially narrow "T" or flared shape are formed over the longitudinal zones to be folded, at the demarcation between one zone and another designed for positoning bottles or other objects to be packaged.

Said "T" notches generally have a thickness equal to at least double the thickness of the sheet of cardboard of which the support is formed, or they may be suitably flared at the corners.

The two "T" notches adjacent to the two major sides extend at the ends of the upper branch of the "T" into a further notch of width equal to the central shank of the T.

Furthermore all the central shanks of the T extend towards the interior of the central flat zone intended for containing the bottles.

The container shaped as heretofore described firstly enables a flat support to be formed consisting of a series of channels, in each of which a row of bottles, containers or other fragile objects may be arranged, these channels being separated from the adjacent channels and/or bounded on the outside by a like number of cusps or ribs or folded cardboard formed from the same base sheet.

Because of the aforementioned T notches, the two flaps of the cardboard sheet may be folded vertically along the two transverse predetermined creasing lines, after the cardboard sheet has been folded for generating the aforementioned ribs.

In this manner two vertical end walls are formed, each provided with separating ribs which are inserted, when straightening the two end walls, into the T notches in the basic cardboard sheet.

The merits and operational and constructional characteristics of the invention will be more evident from the detailed description given hereinafter which illustrates two preferred embodiments given by way of non-limiting example and shown on the figures of the accompanying drawings in which.

FIGS. 1 to 5 show a quandrangular carbdoard sheet 1 divided into two ends parts $A_1$, $A_2$, and a central part B, which sheet comprises parallel to one of its major sides a first predetermined creasing line 2 distant from its edge by a distance equal to the height of the cardboard separation ribs which it is required to generate. Parallel to the line 2 there is a second predetermined creasing line 3 distant from the line 2 by a distance equal to the distance of line 2 from the edge of the cardboard sheet.

In the central part of the cardboard sheet 1 the predetermined creasing line 2 doubles into two lines 2*a* and 2*b* which are separated one from the other by a distance equal to double the thickness of the sheet 1 and are symmetrically positioned with reference to the line 2.

Figure 1:
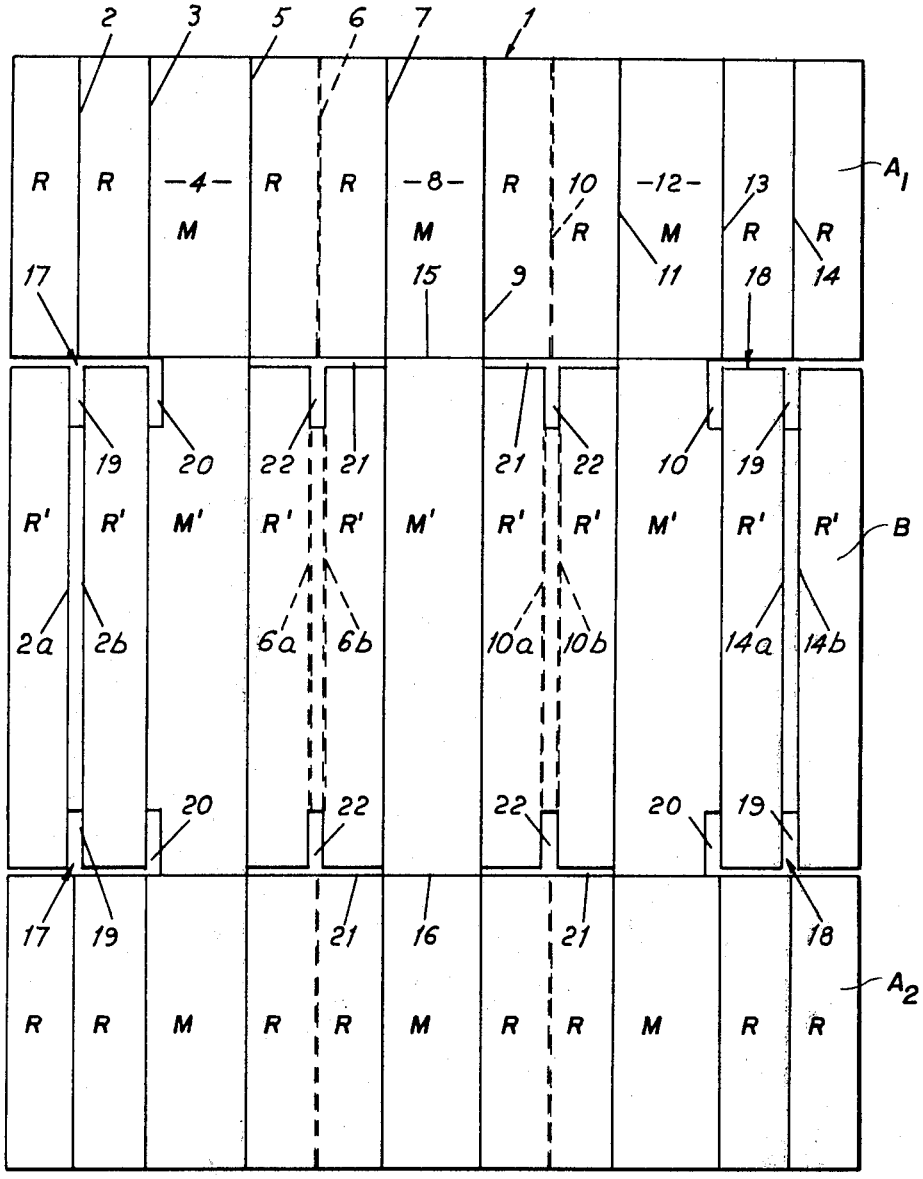
FIG. 1 shows the quadrangular cardboard sheet comprising the predetermined creasing lines and the T notches.

To the right of the line 3 in FIG. 1 there is a first flat zone 4 having a width substantially equal to the diameter of the bottles to be packaged.

Further to the right in FIG. 1 there is a further predetermined creasing line 5 followed by a predetermined creasing line 6 and a further such line 7.

The predetermined creasing lines 5, 6 and 7 are equidistant and their distance apart is equal to the distance between the said lines 2 and 3.

In a like manner to the line 2, the line 6 doubles in the central third into two lines 6*a* and 6*b* which are symmetrical about the line 6 and are separated by a distance equal to double the thickness of the cardboard sheet 1.

The predetermined creasing lines 6, 6*a* and 6*b* have been shown dashed because the sheet is folded at them in the opposite direction to that at the other lines shown by a thin continuous line.

To the right of line 7 there is a further flat zone 8 of width equal to the width of the zone 4. The flat zones 4, 8 and 12 constitute main sections and are therefore also indicated by the generic letter M in the drawing, when they lie in the end parts and M′ when they lie in the central part. The remaining zones become rib sections when the container is formed and are therefore designated by R when they lie in the end parts and R′ when they lie in the central part.

The succession of predetermined creasing lines is repeated identically to the right of zone 8 by the lines 9, 10 and 11, the line 10 doubling in the central third into two lines 10*a* and 10*b*. To the right of line 11 there is a third flat zone 12 of width equal to the width of zones 4 and 8 for containing glass or plastics bottles, while to the right of zone 12 the predetermined creasing lines are repeated identically by the lines 13 and 14, the line 14 doubling in the central third of the sheet 1 into the lines 14*a* and 14*b*.

The sheet 1 is subdivided transversely into said parts three by two transverse predetermined creasing lines 15 and 16.

At the ends of lines 15 and 16 there are like symmetrical notches 17 and 18 comprisng a first portion coinciding substantially with the lines 15 and 16 and of width equal to the thickness of the cardboard sheet 1, and two portions 19 and 20 orthogonal to the former which extend towards the interior of the central third and have a width equal to double the thickness of the cardboard sheet 1.

In particular the first portions 19 of said two portions are placed to correspond with the lines 2*a* and 2*b* on one side of the sheet 1, and with the lines 14*a* and 14*b* on the other side of the sheet 1, while the second portions 20 correspond with the lines 3 and 13.

The zones lying between the lines 5–7 and 9–11 also comprise T notches of which the upper horizontal branch 21 coincides with lines 15 and 16 respectively, while the vertical shank 2 of width double the preceding and equal to double the thickness of the sheet 1 is placed to correspond with the longitudinal lines 6*a* and 6*b*, and 10*a* and 10*b*.

Figure 3:
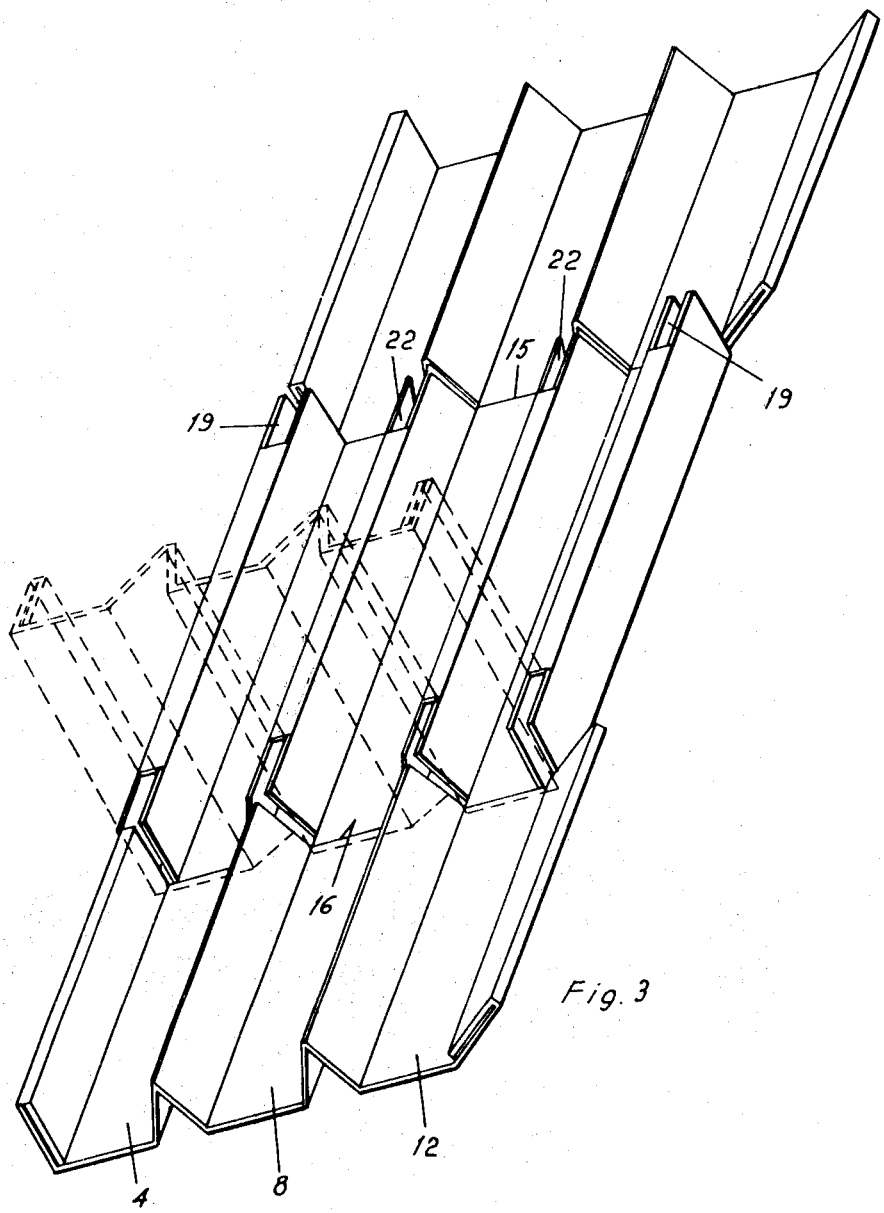
FIG. 3 shows the same sheet at the moment of generating the cardboard support or open container, still in the flat position, but with the folds already made for generating the ribs bounding the channels for containing the rows of containers or bottles.

The sheet, shaped by punching as heretofore described, may first be concertina folded as shown in FIG. 3 to generate a series of longitudinal channels 4, 8 and 12, adapted to contain the rows of glass or plastics bottles to be packaged in their central zone.

The two end flaps of the cardboard sheets may be folded vertically at the two lines 15 and 16 so that the ribs generated by folding the lines 2, 6, 10 and 14 become inserted in the notches 19 and 22 formed in the central zone as better illustrated in FIG. 3.

Figure 4:
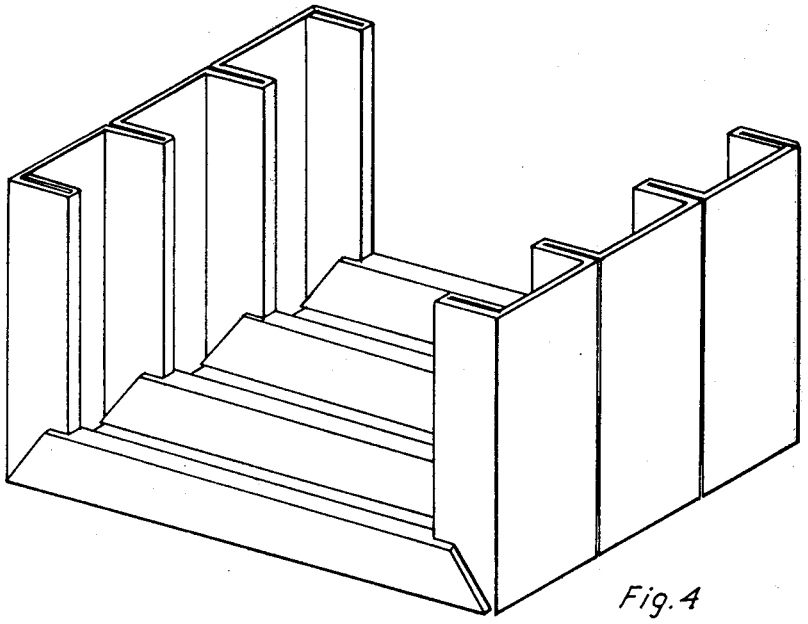
FIG. 4 shows the open support or container already folded for containing bottles and ready for enclosure in the wrapping of thermoretractable plastics material.
Figure 5:
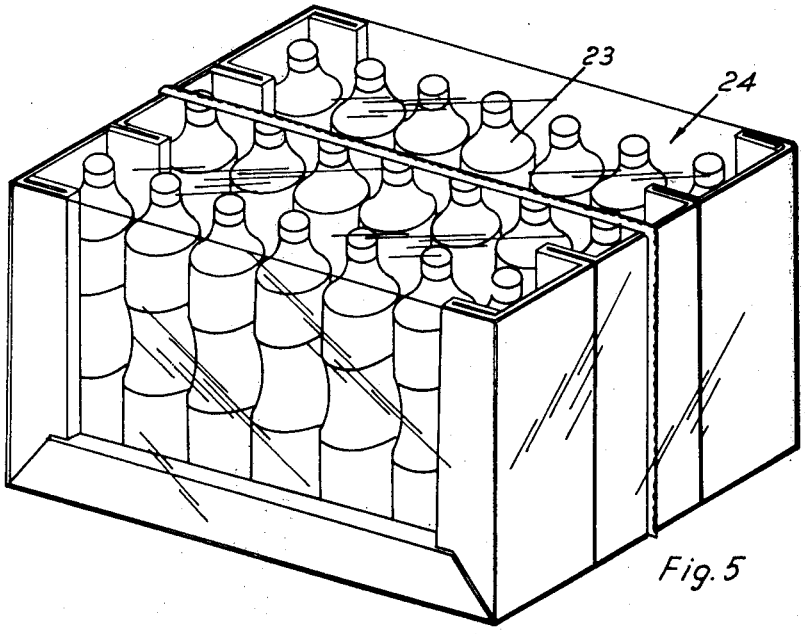
FIG. 5 shows the container full of bottles of synthetic material and enclosed in the sheet of thermoretractable material.

In this manner a disposable open cardboard support or container is obtained as illustrated in FIG. 4 arranged in this particular case to receive three rows of glass or plastics bottles.

The lengths of the two end flaps of the cardboard sheet are equal substantially to the height of the bottles 23 to be packaged. Said bottles 23 are inserted as better illustrated in FIG. 5 and the whole assembly may be enclosed in a sheet of synthetic thermoretractable material 24 in accordance with a known process.

Figure 2:
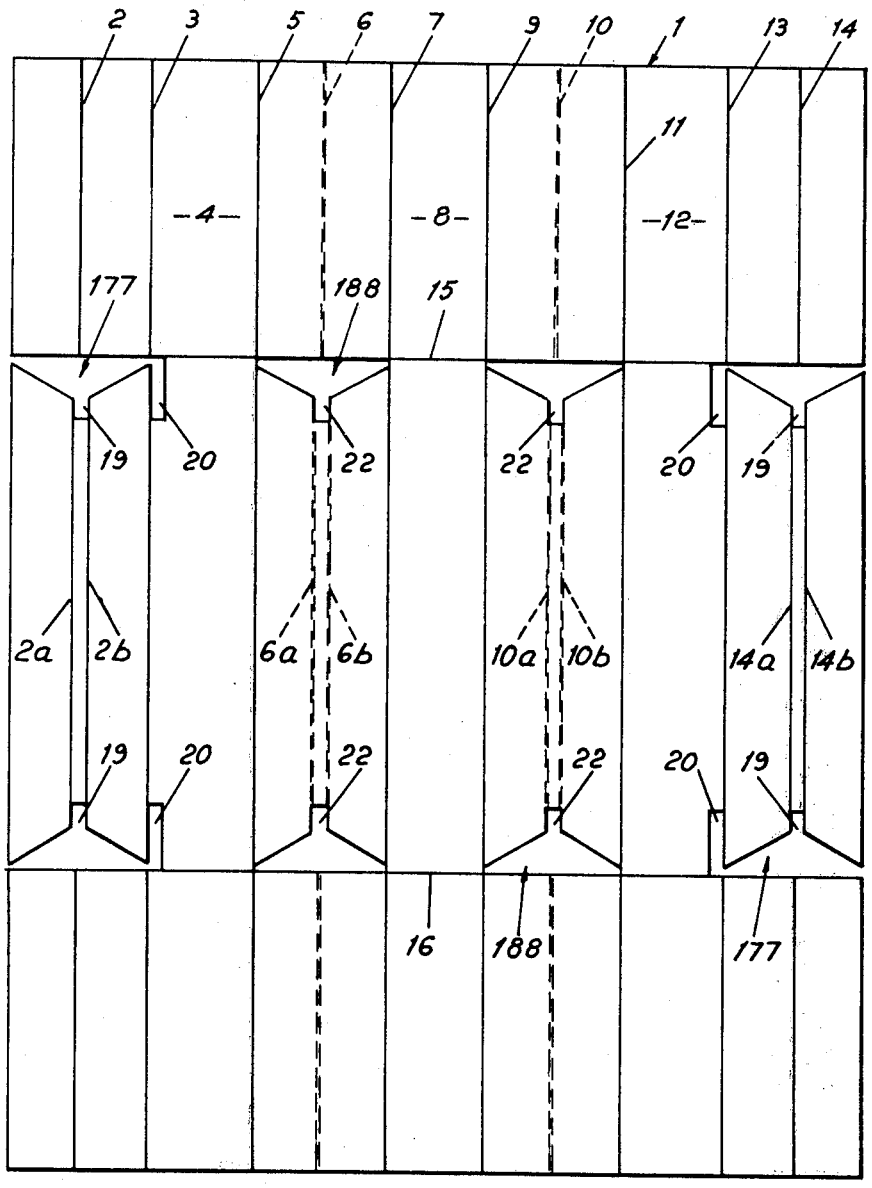
FIG. 2 shows the same sheet with a different configuration of the T notches.

In this manner a congruent assembly containing the bottles 23 is created which has very high resistance to buckling because of the ribs generated by the creasing lines 2, 6, 10 and 14, and a very high resistance to longitudinal bending forces, provided by the ribs formed at the lines 2*a*, 2*b*, 6*a*, 10*a*, 10*b*, 14*a*, 14*b*. FIG. 2 shows the corresponding elements of FIG. 1 with the same reference numerals. The notches 177 and 188 are however of different shape, to facilitate insertion.

Figure 6:
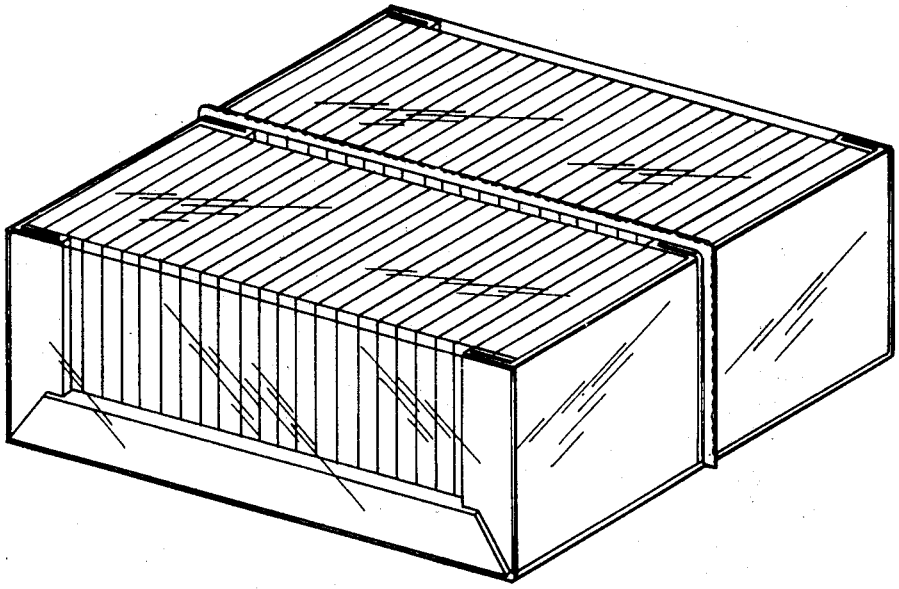
FIG. 6 shows a cardboard container designed for containing ceramic tiles, which differs from that shown in FIGS. 1 to 5 by having only two housings for the products to be packaged.
Figure 7:
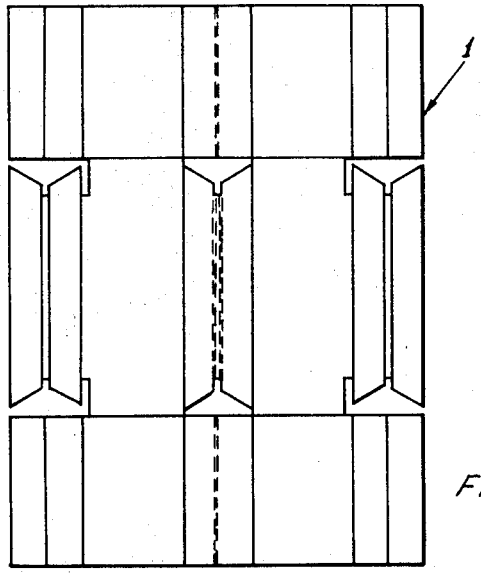
FIG. 7 shows the basic sheet for the container of FIG. 6.

FIGS. 6 and 7 show a simplified container with only two channels, for containing packs of tiles. The construction of this container is identical with that of the preceding construction, except for the smaller number of longitudinal channels.

Figure 8:
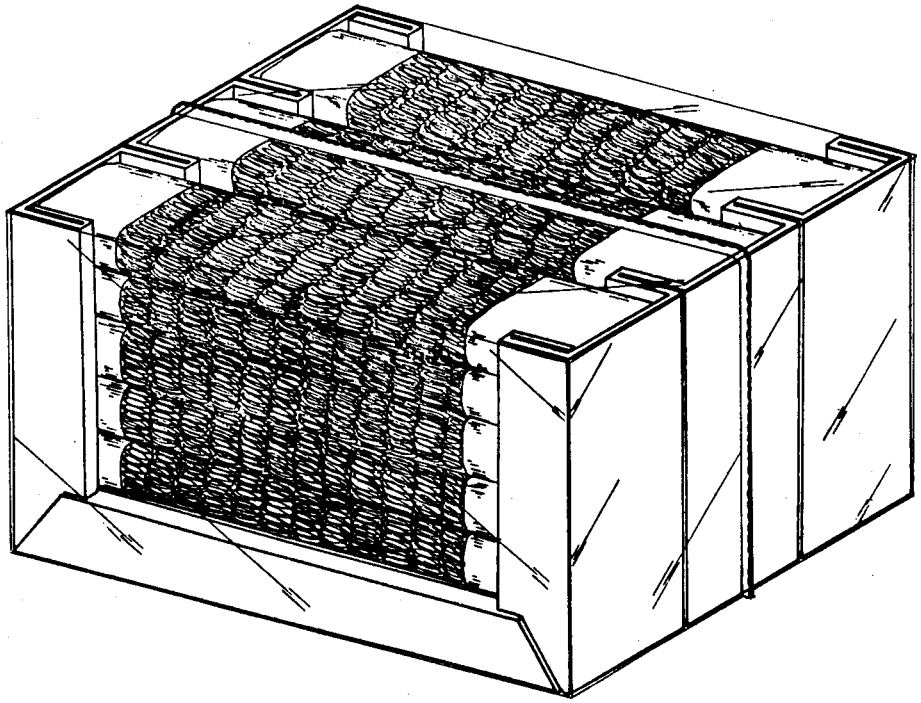
FIG. 8 shows a container of the type illustrated in FIGS. 1 to 5, full of food pasta (ribbon vermicelli).

FIG. 8 shows a different possible use for the container.

A film of adhesive may be applied to predetermined points or zones of mating flaps in order to make the container more consistent on folding.

The invention is not limited to only the embodiments heretofore described, and modifications and improvements may be made to it without leaving the scope of the inventive idea, the fundamental characteristics of which are summarised in the following claims.

What is claimed is:

1. A rectangular sheet of creasable material transversely divided into two end parts ($A_1$ $A_2$) on opposite sides of a central part (B), each end part being divided by longitudinal creases (2–7) into a plurality of main and rib sections (M and R) extending lengthwise of said end parts, with each main section positioned between two rib sections and spaced from the nearest other main section by two rib sections, each main section being separated from said central part by a transverse crease (15, 16) while each rib section is separated from said central part by a transverse slot (21), said central part being likewise divided by longitudinal creases into main and rib sections (M′ and R′) respectively aligned with the main and rib sections in said end parts, and separated from each other by longitudinal creases, those longitudinal creases separating two adjacent rib sections in one of the parts bordering each transverse slot terminating short of that slot by a distance at least equal to the width of said rib sections measured in the direction of said transverse creases so as to leave a longitudinal slot (19, 22) at the end of each of said last mentioned creases intersecting a transverse slot;

whereby when the adjacent rib sections of said end parts are folded together, and the adjacent rib sections of said central part are folded together, and said end parts are bent at right angles to said central part, the rib sections of an adjacent part are seated in each of said longitudinal slots.

2. Sheet as claimed in claim 1 in which the crease separating each of the two outermost main sections of said central part from the adjacent rib section between said outermost main section and the edge of the sheet terminates short of the transverse slot separating the rib sections of said end parts from those of said central part by a distance at least equal to the width of said rib sections, so as to leave a longitudinal slot at each end of said last-mentioned creases.

3. Sheet as claimed in claim 1 in which said longitudinal slots are formed in said central part.

4. Sheet as claimed in claim 1 in which said transverse slots are triangular and each transverse slot merges with a longitudinal slot to form a funnel-shaped opening.

5. Sheet as claimed in claim 1 in which the surfaces of those sections to be folded together comprise zones to which an adhesive has been applied.

6. Sheet as claimed in claim 1 folded into a compartmented box.

7. Sheet as claimed in claim 1 in which all of said main sections are of the same width and all of said rib sections are of the same width.

8. Sheet as claimed in claim 1 in which each pair of adjacent rib sections in said central part is separated by a pair of creases which are themselves separated by a distance equal to twice the thickness of said sheet.

* * * * *